US009541283B2

(12) United States Patent
Wang et al.

(10) Patent No.: US 9,541,283 B2
(45) Date of Patent: Jan. 10, 2017

(54) FUEL DISTRIBUTION DEVICE AND A BURNER

(75) Inventors: Mingkun Wang, Beijing (CN); Congbin Jiang, Beijing (CN); Wei Xin, Beijing (CN); Jinjun Guo, Beijing (CN); Dong Ma, Beijing (CN)

(73) Assignee: Changzheng Engineering Co., Ltd., Beijing (CN)

( * ) Notice: Subject to any disclaimer, the term of this patent is extended or adjusted under 35 U.S.C. 154(b) by 0 days.

(21) Appl. No.: 13/518,567

(22) PCT Filed: Dec. 24, 2009

(86) PCT No.: PCT/CN2009/001548

§ 371 (c)(1),
(2), (4) Date: Aug. 28, 2012

(87) PCT Pub. No.: WO2011/075874

PCT Pub. Date: Jun. 30, 2011

(65) Prior Publication Data

US 2013/0145973 A1 Jun. 13, 2013

(51) Int. Cl.

| | |
|---|---|
| ***F23K 3/00*** | (2006.01) |
| ***F23D 1/00*** | (2006.01) |
| ***F23D 14/78*** | (2006.01) |

(52) U.S. Cl.

CPC ..... *F23D 1/005* (2013.01); *F23D 1/00* (2013.01); *F23D 14/78* (2013.01); *F23K 3/00* (2013.01); *F23D 2214/00* (2013.01)

(58) Field of Classification Search

CPC ..... F23K 3/02

(Continued)

(56) References Cited

U.S. PATENT DOCUMENTS 820,236 A * 5/1906 Moore ..... 110/104 B
940,313 A * 11/1909 Harding et al. ..... 110/104 B (Continued)

FOREIGN PATENT DOCUMENTS

AT WO 9421963 A1 * 9/1994 ..... F23C 7/002
CN 2510740 Y 9/2002

(Continued)

OTHER PUBLICATIONS

International Search Report mailed Oct. 8, 2010 for Application No. PCT/CN2009/001548 (8 Pages).

*Primary Examiner* — Jason Lau
(74) *Attorney, Agent, or Firm* — Nutter McClennen & Fish LLP; David J. Powsner; Derek P. Roller

(57) ABSTRACT

Fuel distribution devices for use with burners are described herein. One embodiment of a fuel distribution device for a burner can include an inlet end having a disc-like annular cover with inlet openings, an outlet end having a disc-like annular support plate with groups of distribution openings, and cylindrical inner and outer walls. These components can define a distribution channel and the device can further include fuel feeding tubes extending from the inlet openings into the distribution channel, and each of the fuel feeding tubes can divide into branch pipes extending through the distribution channel to the annular support plate. Moreover, the branch pipes extending from a same feeding tube can be in communication with distribution openings within a same group, and the branch pipes can be coiled spirally about the inner wall and connected to distribution openings at an inclined angle such fuel ejected therefrom has a tangential velocity.

20 Claims, 4 Drawing Sheets

(58) Field of Classification Search
USPC ..... 110/261, 267, 104 R, 347, 104 B, 264,110/101 R, 102, 262, 265, 263, 260; 431/175, 431/187, 195–201; 137/262, 265; 406/123
See application file for complete search history.

(56) References Cited

U.S. PATENT DOCUMENTS

| | | | | | |
|---|---|---|---|---|---|
| 1,708,505 | A | * | 4/1929 | Jackson | 110/104 R |
| 1,875,808 | A | * | 9/1932 | Gerquest | 431/114 |
| 2,361,117 | A | * | 10/1944 | Millett | 431/23 |
| 2,364,633 | A | * | 12/1944 | Hardgrove | 406/155 |
| 2,380,041 | A | * | 7/1945 | Hardgrove | 122/235.11 |
| 2,800,091 | A | * | 7/1957 | Otto Lotz et al. | 110/264 |
| 4,313,386 | A | * | 2/1982 | Boldt et al. | 110/104 R |
| 4,351,645 | A | * | 9/1982 | Marion et al. | 48/61 |
| 4,928,605 | A | * | 5/1990 | Suwa et al. | 110/261 |
| 5,546,874 | A | * | 8/1996 | Breen et al. | 110/261 |
| 5,944,507 | A | * | 8/1999 | Feldermann | 431/189 |
| 5,957,678 | A | * | 9/1999 | Endoh et al. | 431/5 |
| 6,155,183 | A | * | 12/2000 | Vierstra et al. | 110/345 |
| 7,004,408 | B2 | * | 2/2006 | Vecchiet et al. | 239/558 |
| 2001/0032572 | A1 | * | 10/2001 | Mukai et al. | 110/262 |
| 2004/0234912 | A1 | * | 11/2004 | Sarv et al. | 431/183 |
| 2006/0000395 | A1 | * | 1/2006 | Joshi et al. | 110/267 |
| 2008/0047196 | A1 | * | 2/2008 | Schingnitz | 48/197 R |
| 2008/0145657 | A1 | * | 6/2008 | Igarashi et al. | 428/402 |

FOREIGN PATENT DOCUMENTS

| | | | | | |
|---|---|---|---|---|---|
| CN | 1710333 | A | | 12/2005 | |
| DE | 498123 | C | | 5/1930 | |
| DE | 3612682 | A1 | | 10/1987 | |
| WO | WO 9012987 | A1 | * | 11/1990 | F23D 17/00 |
| WO | 93/06417 | A1 | | 4/1993 | |

* cited by examiner

FUEL DISTRIBUTION DEVICE AND A BURNER

FIELD OF THE INVENTION

The present invention relates to a burner, particularly relates to a fuel distribution device for such as powdered coal and a burner with the fuel distribute device.

BACKGROUND

It is found that there are various factors that may cause an unstable operation of a gasification apparatus, and one common condition is an unexpected feeding interruption of coal material such that an uneven distribution of coal at the outlet of the powder channel is occurred. As a result, the local oxygen-coal ratio increases sharply and therefore the gasification apparatus will be over heated locally, which consequently may lead to a concatenation of shut down of the system or even a damage to the gasification apparatus during operation. This will cause a severely negative impact on the safety, stability and cost-efficiency of the gasification apparatus.

In the known gasifying coal technology, Texaco Co. provides a single burner arranged in atop position and utilizing coal-water slurry as its fuel, which includes three channels for transporting combustion materials: a central channel for oxygen, a second channel for coal-water slurry and an outermost channel again for oxygen. When the coal-water slurry feeding in the second channel is suddenly interrupted, the flow of the coal slurry at the burner nozzles will decrease sharply and inevitably result in shut down of the system. Furthermore, the interruption of coal feeding results in increasing of oxygen-coal ratio instantly, in turn increasing of the temperature of the furnace and aggravating the oxidative corrosion therein, which will cause disadvantageous affects on the furnace wall and the burner.

Shell Co. provides a powdered coal gasifying burner which utilizes powdered coal as a fuel. The apparatus burning the powdered coal is configured as four separated burners which are arranged at the middle or lower part of the furnace cavity evenly along a circumference direction, and these four burners produce flames opposed to one another in the furnace cavity, and the synthesis gas as a resultant is discharged from the upper end of the gasifying furnace while the slag is discharged from the lower end. In this apparatus, each burner has an independent feeding conduit and a corresponding control system, such that upon interruption of feeding coal of one feeding conduit, the other burner symmetrically opposed thereto can be shut down and the rest two burners in opposed positions remain to work to ensure the uniformity of the temperature field in the furnace, which may prevent a damage to the elements due to a deviant combustion. However, the even arrangement of four burners in the furnace cavity requires a precise manufacturing and installation of the burners; and moreover, the above-mentioned arrangement cannot give a solution to the problem that the interruptions of coal feeding are occurred in two feeding conduit of burners located in asymmetric positions at the same time, resulting in the deviant combustion, the oxygen-coal ratio sharply increased and the temperature of the furnace increased, therefore the oxidative corrosion will be aggravated and the furnace wall and the burner may still be damaged.

The applicant of this application disclosed a swirl burner for combustible powder under CN invention patent publication No. CN1710333A, which comprises 2-5 powder tubes arranged in a powder channel of the burner and distributed evenly along a circumference direction of the powder channel. The object of the invention is to adjust the workload of burner by adjusting the supply amount of the powders via increasing or reducing the tubes, and to prolong the service life of burner by optimizing the cooling effects by means of a multi-compartment cooling mechanism. However, there also exist in said powder burner similar problems that, in the event that one or several powder tubes fail or the feeding thereof is interrupted, the non-uniform burning is occurred at the outlet of the powder channel, resulting in higher temperature of the furnace, which will in turn destroy the furnace wall and the burner.

SUMMARY OF THE INVENTION

The primary object of the present invention is to overcome the defects in the prior arts by means of providing a fuel distribution device for a burner, in particular for a powdered coal burner. The fuel distribution device is designed to provide an even distribution of fuel at an outlet end of the device even in the event of failure of one or several of fuel feeding pipes or the interruption of feeding thereof.

Therefore, the present invention provides a fuel distribution device for a burner, comprising an inlet end, an outlet end and a distribution channel extending therebetween as well as n fuel feeding tubes extending from the inlet end into the distribution channel, wherein the outlet end is provided with n groups of distribution openings, each of the groups includes m distribution openings distributed evenly along a circumference direction of the outlet end; each of the fuel feeding tubes is divided into m feeding branch pipes extending therefrom, and the m feeding branch pipes extending from each of the fuel feeding tubes are communicated with the m distribution openings of each group respectively, wherein m, n are positive integers greater than or equal to 2. As a result, there is an interval angle of 360°/m formed between the respective outlets of any two adjacent branch pipes of the m feeding branch pipes extending from each of the feeding tubes. In the event that one or more of the n fuel feeding tubes is in failure or the fuel feeding thereof is interrupted, such configuration of the fuel distribution device is able to maintain an even distribution of fuel such as powdered coals at the outlet end of the fuel distribution device by the respective m feeding branch pipes of the rest fuel feeding tubes.

Preferably, the respective m distribution openings of any two of the n groups of the distribution openings are arranged alternately along the circumference direction of the outlet end such that there is an interval angle of 360°/n×m formed between any two adjacent openings of the n×m distribution openings. The outlet end is configured to arrange outlets of the respective m feeding branch pipes extending from any two of the n fuel feeding tubes such that there is an interval angle of 360°/n×m formed between any two adjacent outlets of the n×m feeding branch pipe outlets. More preferably, said n×m distribution openings are configured to be distributed in a same circumference evenly along circumference direction at the outlet end, which provides a more even distribution for outlets of the n×m feeding branch pipes at the outlet end so as to provide thereon a more even distribution of fuel such as powdered coal. In this invention, for the purpose that fuels such as powdered coal from a fuel feeding tube is distributed into m corresponding feeding branch pipes evenly, a fuel dividing mechanism is preferably arranged between each of the fuel feeding tubes and the corresponding m feeding branch pipes.

According to an aspect of the invention, the distribution channel is formed between an inner cooling jacket and an outer cooling jacket of the burner, and the respective m feeding branch pipes extending from each of the n fuel feeding tubes is coiled about the outside of the inner cooling jacket sequentially. Since the feeding branch pipes arranged around the outside of the inner cooling jacket, a fuel such as powdered coal may advantageously gain a tangential velocity during injection to form a more powerful swirl in order to accelerate the mixture of the fuel such as powdered coal and the oxidant. It should be understood by the person skilled in the art, in the event that the powdered coal is used as fuel, the diameters of the cooling jackets should be taken into consideration when selecting the thread pitch between the coiled branch pipes so as to prevent the powdered coal from blocking the branch pipes or forming a larger flow resistance.

This invention also provides a burner, including an igniter, an oxidant channel and a fuel distribution device coaxially and outwardly arranged in sequence about the igniter, the fuel distribution device having an inlet end, an outlet end and a distribution channel extending therebetween as well as n fuel feeding tubes extending from the inlet end into the distribution channel, wherein the outlet end has n groups of distribution openings arranged thereon, each of the groups includes m distribution openings distributed evenly along the circumference direction of the outlet end, each of the fuel feeding tubes is divided into m feeding branch pipes extending therefrom, and the m feeding branch pipes extending from each of the fuel feeding tubes are communicated with the m distribution openings of each group respectively, and wherein m, n are positive integers greater than or equal to 2.

According to an aspect of the invention, in the burner mentioned above, the outlet end is configured such that the respective m distribution openings of any two of n groups are arranged alternately along circumference direction of the outlet end, in order that there is an interval angle of 360°/n×m formed between any two adjacent distribution openings of the n×m distribution openings.

In another aspect of the invention, for the purpose of a more even distribution of fuel such as powdered coal at the outlet end, the n x m distribution openings are more preferably configured to be distributed evenly in a same circumference along a circumference direction to provide a more even distribution of the outlets of the n x m feeding branch pipes at the outlet end.

In this invention, it is preferred that an inner cooling jacket is arranged between the oxidant channel and the fuel distribution device, an outer cooling jacket is arranged outside the fuel distribution device, and thus a cooling channel is formed in the internal space of each jacket in which the flowing media can be water or any other suitable coolant, such that during a long period of burning, a damage to the burner caused by flame will be reduced greatly, which is beneficial to the service life of the burner.

In an aspect of the invention, both the inner cooling jacket and the outer cooling jacket are configured to have an annular cavity respectively which is divided into an inner cavity and outer cavity by means of a baffle arranged therein, wherein the outer cavity is communicated with a coolant inlet while the inner cavity is communicated with a coolant outlet such that the coolant flows from the outer compartment into the inner compartment in the cooling jackets. In a burner according to the invention, an annular support plate is arranged at the outlet end of the fuel distribution device, and said n×m distribution openings are arranged in the plate for fixing the n×m feeding branch pipes to the outlet end.

In the fuel distribution device and the burner according to the invention, in the event that one or more feeding tubes is in failure or the feeding thereof is interrupted, the rest of the feeding tubes and the corresponding feeding branch pipes thereof can still maintain the normal fuel feeding. Meanwhile, since the outlets of the rest of feeding branch pipes are still distributed symmetrically at the outlet end of the distribution device around the centre axis of the burner, the fuel such as combustible powder is evenly jetted for the most part at the outlet end of the distribution device, thus the fire maintains uniformly and the shape of the same will not change so as to avoid shut down of the system or a damage to the device caused by the non-uniform burning.

BRIEF DESCRIPTION OF THE DRAWINGS

This invention will be described in detail in connection with the accompanying drawings, in which the same reference numerals will be designated to the same element, and in which.

DETAILED DESCRIPTION OF THE PREFERRED EMBODIMENT

Figure 1:
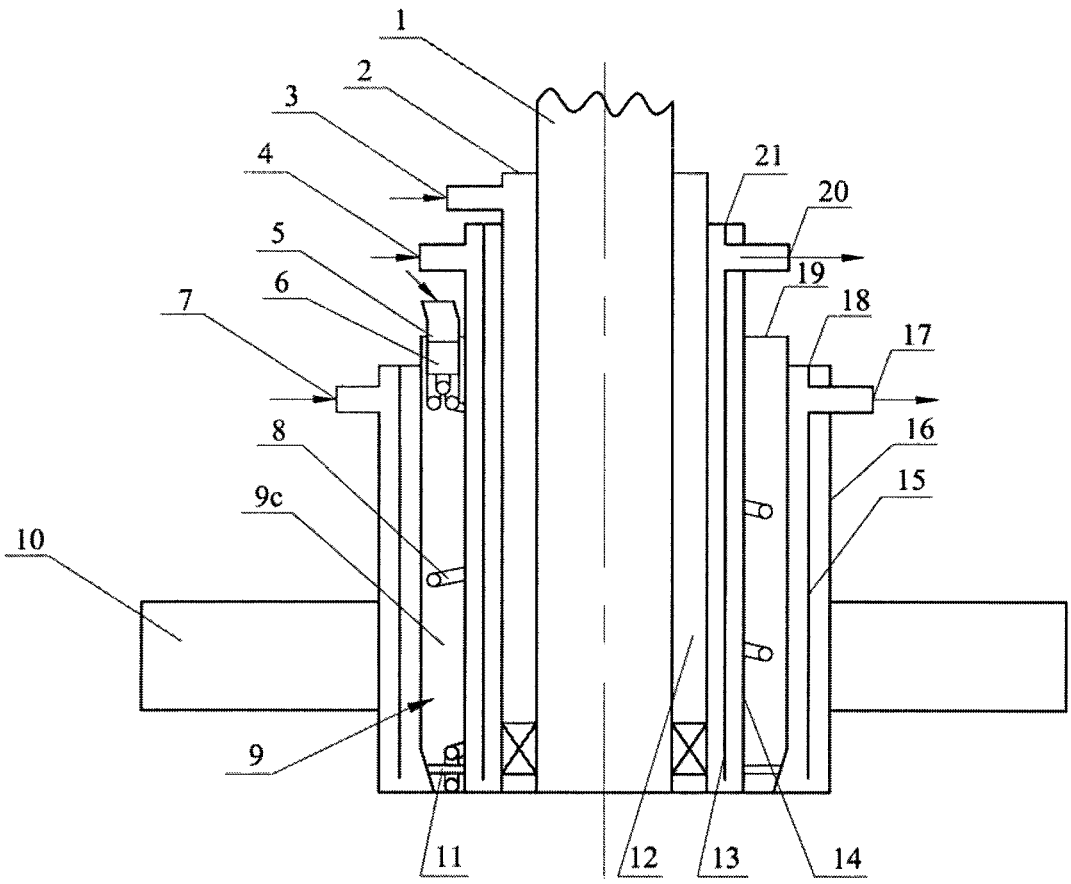
FIG. 1 is a cross sectional view of the structure of the powdered coal burner according to one embodiment of the invention.

FIG. 1 shows a sectional view of the structure of the powdered coal burner according to one embodiment of the invention, from which it can be seen that the powdered coal burner includes an igniter 1 arranged in its central portion. The igniter has an electrical igniter and two separate channels for combustion gas and oxidant respectively (not shown). Arranged outside the igniter 1 is an oxidant channel 12, which has an oxidant inlet 3, through which the oxidant flows into the oxidant channel 12, and an oxidant channel cover 2 for sealing the oxidant channel 12. Because of greater heat radiation of flame to the burner, the powdered coal burner advantageously includes an inner cooling jacket 14 and an outer cooling jacket 16 coaxially and outwardly arranged in sequence about the oxidant channel 12.

Figure 2:
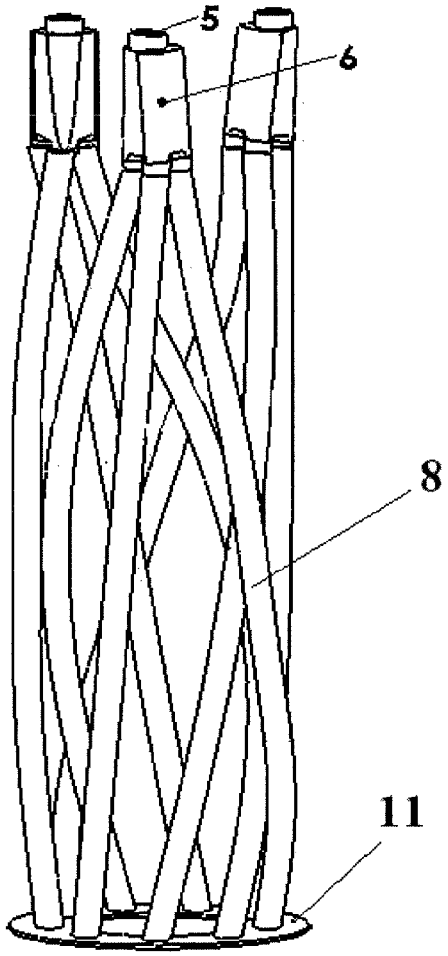
FIG. 2 is a schematic view of the structure of the powdered coal distribution device according to the embodiment of the invention, showing a specific arrangement of the powdered coal feeding tubes and the respective feeding branch pipes extending from each of them.
Figure 5:
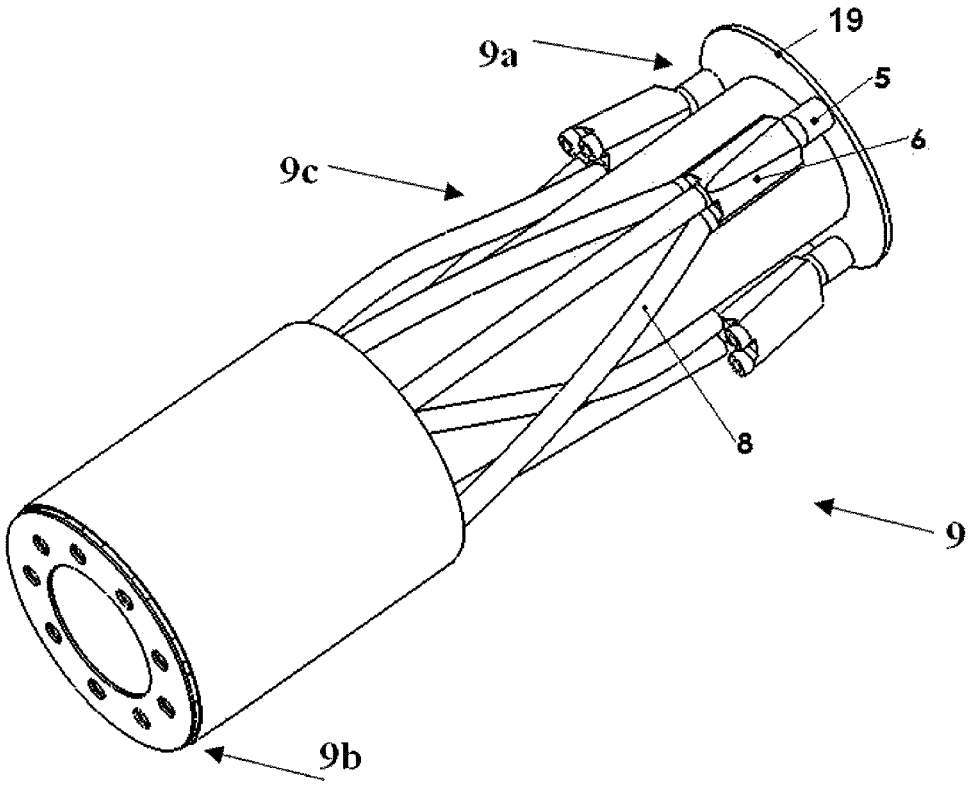
FIG. 5 is a schematic view showing the powdered coal feeding tubes and the respective feeding branch pipes from them and around the inner cooling jacket as showed in FIG. 2.

Arranged between the inner cooling jacket 14 and the outer cooling jacket 16 is a powdered coal distribution device 9, which has an inlet end 9*a*, an outlet end 9*b* and a distribution channel 9*c* extending between them (refer to FIG. 2 and FIG. 5). The inlet end 9*a* is sealed by a distribution channel cover 19, and a support plate 11 which connects the inner cooling jacket 14 to the outer cooling jacket 16 is preferably arranged at the outlet end of the powdered coal distribution device 9. While the powdered coal is used as the fuel of burner in this embodiment, it will be understood by the person skilled in the art that combustible gas, oil or any other combustible powders also may be used as the fuel for this burner.

According to the invention, the powdered coal distribution device 9 includes n powdered coal feeding tubes 5 extending through the cover 19 at the inlet end 9*a*, each of the powdered coal feeding tube 5 is divided into m feeding branch pipes via a powdered coal dividing mechanism 6 arranged in the distribution channel 9*c*. Arranged on the annular support plate 11 at the location of the outlet end 9*b* are n groups of distribution openings, each of which includes m distribution openings evenly along a circumference direction of the outlet end. The respective m feeding branch pipes 8 extending from each of the powdered coal feeding tubes 5 are coiled sequentially around the inner cooling jacket 14 by a certain angle and then communicated with the m distribution openings of each group respectively. The m, n are positive integers lager than or equal to 2. In this regard, an interval angle of 360°/m is formed between any two of contiguous feeding branch pipes 8 extending from a same powdered coal feeding tube 5. In this invention, said n×m distribution openings on the annular support plate 11 are provided evenly in a same circumference along the circumference direction of the annular support plate 11, such that outlets of the n×m feeding branch pipes 8 of the n feeding tubes 5 are distributed evenly along the circumference direction of the outlet end 9*b*, and that an interval angle of 360°/n×m is formed between the outlets of any two adjacent feeding branch pipes 8.

In the embodiment, the inner cooling jacket 14 is sealed by an inner cooling jacket cover 21 to form an annular cavity in which a baffle 13 is arranged and divides it into an outer cavity which is communicated with an coolant inlet 4 and an inner cavity which is communicated with an coolant outlet 20, so as to form an inner and outer cooling channels, in which the coolant flows from the inlet 4 at the top end of inner cooling jacket 14 into the outer cooling channel and then flows out of outlet 20 through the inner cooling channel. The outer cooling jacket 16 arranged outside the powdered coal distribution device 9 is of the similar structure to the inner cooling jacket 14, and also has a baffle 15 dividing an annular cavity into an inner cavity and an outer cavity, a coolant inlet 7 communicated with the outer cavity and a coolant outlet 17 communicated with the inner cavity. A connecting flange 10 is mounted on outside the outer cooling jacket 16, which has a sealed connection with the furnace body (not shown). It should be understood by the person skilled in the art, in the said cooling jackets, the media could be water or any other suitable coolant.

Because of this configuration of the cooling jackets, the coolants adjacent the outlet end of burner flow along the sectional area reducing direction of the channels, such that the flow velocity and turbulent velocity of the coolant is increased to improve the convection heat-exchange effect and the cooling effect so as to prevent the burner from being damaged by the radiation of flame and the high-temperature gas, thus to elongate the service life of the burner.

Figure 3:
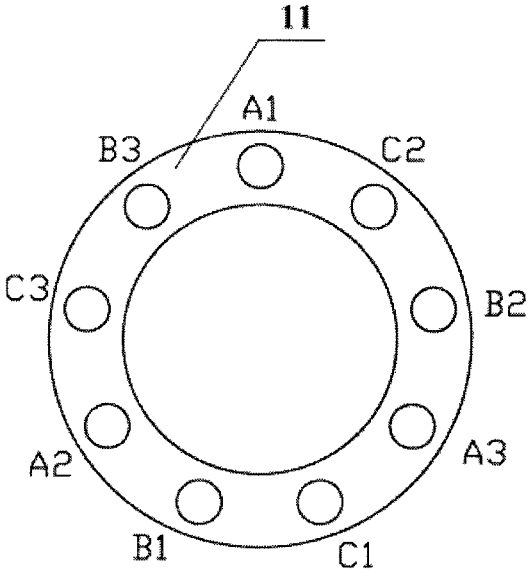
FIG. 3 is a schematic view showing the distribution of the powdered coal feeding branch pipes at the outlet end of the powdered coal distribution device as showed in FIG. 2.
Figure 4:
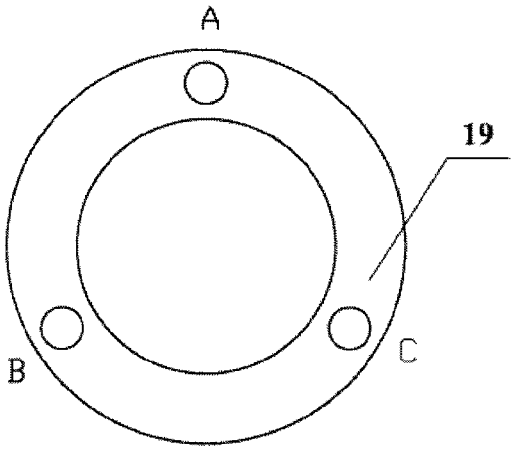
FIG. 4 is a schematic view showing a distribution of the distribution inlets at the inlet end of the powdered coal distribution device according to the embodiment of the invention.

Refer to FIG. 2 and FIG. 5, in which a powdered coal distribution device 9 according to one embodiment of the invention is shown. In this embodiment, m, n=3, that is, arranged at the inlet end 9*a* of the powdered coal distribution device 9 and extending into the distribution channel 9*c* are three powdered coal feeding tubes 5, which extend through respectively the three openings A, B, C arranged in a circumference on the distribution channel cover 19 (see FIG. 4), such that an interval angle of 360°/3=120° is formed between two adjacent powdered coal feeding tubes, each of which is divided into three feeding branch pipes 8 via the powdered coal dividing mechanism 6. As shown in FIG. 3, arranged on the annular support plate 11 at the outlet end 9*b* of the powdered coal distribution device 9 are 3 groups of distribution openings, each of which includes three distribution openings, i.e. Group I: A1, A2, A3, Group II: B1, B2, B3 and Group III: C1, C2, C3, and moreover said three groups of distribution openings are alternately and evenly distributed along a circumference in an order of A1, C2, B2, A3, C1, B1; A2, C3, B3, such that an interval angle of 360/3×3=40° is formed between any two adjacent distribution openings for example A1, B3. In configuring the powdered coal distribution device 9, a first group of three feeding branch pipes 8 extending from one of the three powdered coal feeding tubes 5 are communicated with the distribution openings A1, A2, A3 of Group I and fixed to the support plate 11 after being wound around the inner cooling jacket 14 by a certain angle respectively and sequentially; and then the other feeding branch pipes 8 extending from the rest two powdered coal feeding tubes 5 are communicated with the distribution openings B1, B2, B3 of Group II and the distribution openings C1, C2, C3 of Group III respectively and fixed to the support plate 11 after being wound around inner cooling jacket 14 by a certain angle respectively and sequentially, such that the outlets of the feeding branch pipes 8 are distributed evenly along a circumference at the outlet end of powdered coal distribution device 9.

It should be understood by the person skilled in the art, with such a configuration, in the event that one powdered coal feeding tube 5 is in failure or the feeding thereof interrupted, for example coal feeding of one tube extending through the opening A is interrupted, the rest two powdered coal feeding tubes extending through the openings B, C can still operate normally, such that at the outlet of the powdered coal distribution device 9, the six feeding branch pipes extending from the two powdered coal feeding tubes B, C still operate well at the positions of the distribution openings B1, B2, B3, C1, C2, C3 arranged on a circumference and symmetrically with regard to the center axis of the igniter 1; or, in the event that two powdered coal feeding tubes are in failure or the feedings thereof interrupted, for example the two feeding tubes extending through the openings A and B fail, the powdered coal feeding tube extending through the opening C can still operate well, such that at the outlet end of the powdered coal distribution device 9, there are still three feeding branch pipes 8 extending from the powdered coal feeding tube C in well operation at the positions of the distribution openings C1, C2, C3 arranged in a circumference and symmetrically with regard to the center axis of the igniter 1. Therefore, the shape of the fire of the burner would not change even upon failure of one or two of the three powdered coal feeding tubes, so as to avoid shut down of the system or damages to the gasification equipment caused by the non-uniform burning. In a normal operation, the powdered coal jetted from each feeding branch pipes 8 will meet and mix with the oxidant from the inner side to generate separate small flame, and thus adjacent small flames meet each other and generate a loop of uniform fire, resulting in uniformity of the furnace temperature.

Figure 6:
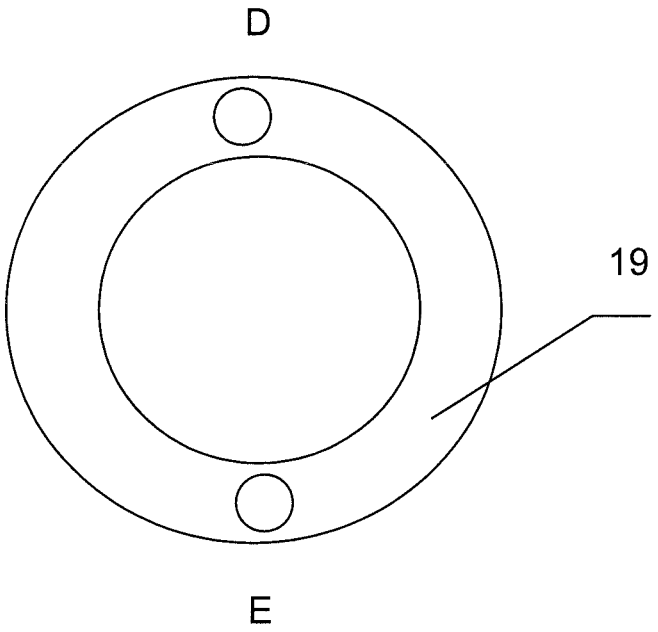
FIG. 6 is a schematic view showing a distribution of the powdered coal feeding tubes at the inlet end of the powdered coal distribution device according to another embodiment of the invention.
Figure 7:
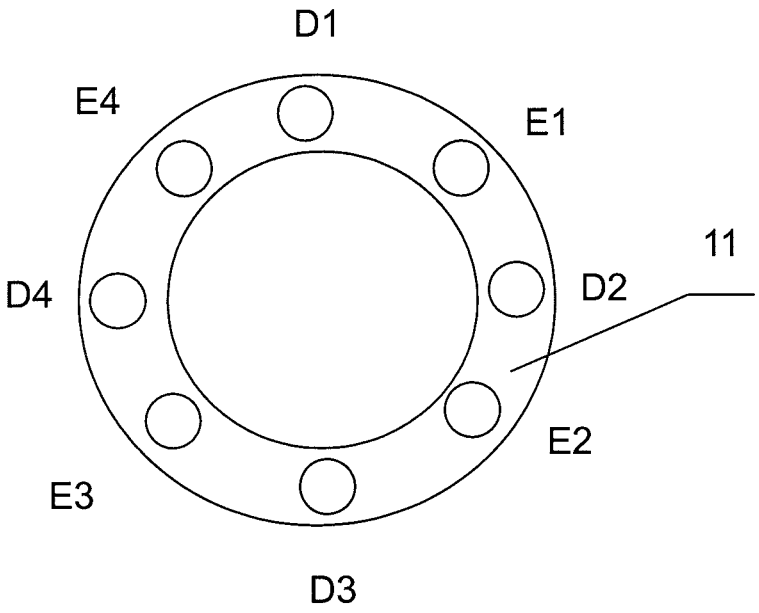
FIG. 7 is a schematic view showing a distribution of the distribution outlets at the outlet end of the powdered coal distribution device as showed in FIG. 6.

The FIGS. 6-7 show a powdered coal distribution device according to another embodiment of the invention. In this embodiment, n=2, m=4, i.e. extending through the distribution channel 9*c* and arranged at the inlet end 9*a* of the powdered coal distribution device 9 are two powdered coal feeding tubes 5, which extend respectively through two openings D, E arranged in a circumference on distribution channel cover 19 (see FIG. 6), such that an interval angle of 360°/2=180° is formed between two adjacent powdered coal feeding tubes each of which is divided into 4 feeding branch pipes 8 via the powdered coal dividing mechanism 6. As shown in FIG. 7, arranged on the annular support plate 11 at the outlet end 9*b* of the powdered coal distribution device 9 are two groups of distribution openings, each of which includes four distribution openings, i.e. Group I: D1, D2, D3, D4, and Group II: E1, E2, E3, E4, and moreover the two groups of distribution openings is alternately and evenly distributed along a circumference in an order of D1, E1, D2, E2, D3, E3, D4, E4, such that an interval angle of 360/2×4=45° is formed between any two adjacent distribution openings for example D1, E1. In the process of configuring the powdered coal distribution device 9, a first group of four feeding branch pipes 8 extending from one of the two powdered coal feeding tubes 5 are communicated with the distribution openings D1, D2, D3, D4 of Group I and then fixedly mounted on the support plate 11 after being wound around the inner cooling jacket 14 by a certain angle respectively and sequentially; then a second group of four feeding branch pipes 8 extending from the other powdered coal feeding tube 5 are communicated with the distribution openings E1, E2, E3, E4 of Group II and fixedly mounted to the support plate 11 after being wound around the inner cooling jacket 14 by a certain angle respectively and sequentially, such that the outlets of the eight feeding branch pipes 8 are distributed evenly along a circumference at the outlet end of the powdered coal distribution device 9.

With the above configuration, in the event that one powdered coal feeding tube 5 is in failure or the coal feeding thereof interrupted, for example feeding of a feeding tube extending through the opening D is interrupted, the powdered coal distribution device 9 can still operate well, and thus at the outlet end 9of the powdered coal distribution device 9, the four feeding branch pipes extending through the opening E still operate well at the positions of the distribution openings El, E2, E3, E4 arranged in a circumference and symmetrically with regard to the center axis of the igniter 1; or,in the event that powdered coal feeding tube at the opening E is in failure, the feeding tube at D can still operate well, and thus at the outlet end of the powdered coal channel, the four feeding branch pipes D1, D2, D3, D4 extending from the powdered coal feeding tube at the opening D are still shown to be distributed in a circumference and symmetrically with regard to the center axis of the igniter 1. Therefore, the shape of the fire of the burner would not change in each of the above-mentioned cases, so as to avoid shut down of the system or damage to the gasification equipment caused by the non-uniform fire. In a normal operation, the powdered coal jetted from each feeding branch pipes 8 will meet and mix with the oxidant from the inner side to generate separate small flame, and a plurality of adjacent small flames then merge into a loop of uniform fire, resulting in uniformity of the furnace temperature.

In this invention, the configurations of the powdered coal feeding tubes 5 and the corresponding powdered coal feeding branch pipes 8 in the powdered coal distribution device 9 are not limited to the embodiments described above in detail. The disclosure is intended to embrace all such embodiments within the spirit of the invention, as long as the m feeding branch pipes 8 extending from each of the powdered coal feeding tube 5 are configured to have its outlets evenly distribute in a circumference at the outlet end of the powdered coal distribution device and to be symmetrical with regard to the center axis of the igniter 1.

The operation of powdered coal burner according to the invention is as follow: at first a powdered coal is entrained by high-press inert gas and conveyed into at least two powdered coal feeding tubes 5 in the powdered coal distribution device 9, then divided evenly by the powdered coal dividing mechanisms into a plurality of sub-flows, which enter into the corresponding powdered coal feeding branch pipe and are jetted from the distribution outlets of the powdered coal distribution device, and then ignited by the igniter after mixed with the oxygen jetted from the oxidant channel and formed thereof a swirl, therefore an even, strong and short fire is established. The igniter is shut down once the fire is stable; and upon finishing the operation of powdered coal burner, at first the feeding of the powdered coal is stopped followed by stopping the feeding of the oxidant. During the operation of the burner, the coolant which is water or the like remains circulate in the inner cooling jacket and the outer cooling jacket.

Although exemplary embodiments to implement the invention are illustrated in above, it is intended that the scope of the invention is not limited thereto, and any variation or substitution which can be easily made by the person skilled in the art within the present disclosures shall be regarded as falling into the scope of the invention. Further, those that are not described in detail in the description are considered well known to the person skilled in the art.

What is claimed is:

1. A fuel distribution device (9) for a burner, comprising:

an inlet end (9*a*) comprising a disc-like annular cover (19) having n inlet openings each configured to receive a high pressure fuel;

an outlet end (9*b*) comprising an annular support plate (11) in the form of a planar disc having n groups of fuel distribution openings from which the high pressure fuel is jetted, each of the groups including m fuel distribution openings respectively, wherein the m distribution openings in the same group are distributed evenly along a circumference of the annular support plate (11) and the n groups of fuel distribution openings are arranged along the circumference of the annular support plate;

a cylindrical inner wall, a cylindrical outer wall, and a distribution channel (9*c*) defined by the annular cover (19), the annular support plate (11), the inner wall and the outer wall and forming an annular cavity;

n fuel feeding tubes (5) through which the high pressure fuel is jetted, the n fuel feeding tubes extending from the n inlet openings, respectively, of the annular cover (19) into the annular cavity of the distribution channel (9*c*), wherein each of the n fuel feeding tubes (5) is divided into m feeding branch pipes (8) extending within the annular cavity of the distribution channel (9*c*) from the fuel feeding tubes (5) to the annular support plate (11), and wherein the m feeding branch pipes (8) extending from the same fuel feeding tube (5) are in communication with the respective m fuel distribution openings in the same group respectively, and wherein m, n are positive integers greater than or equal to 2; and a fuel dividing mechanism (6) arranged between each of the n fuel feeding tubes (5) and the respective m feeding branch pipes (8), the fuel dividing mechanism comprising a multi-nozzle that divides the high pressure fuel received at the n inlet opening among the m feeding branch pipes through which the high pressure fuel is jetted;

wherein the n inlet openings are distributed evenly along a circumference of the annular cover (19);

wherein the feeding branch pipes (8) are configured to be coiled spirally about the inner wall and thus the feeding branch pipes (8) are configured to be tangentially inclinedly connected to the respective fuel distribution openings of the annular support plate (11) with respect to the annular support plate (11) such that high pressure fuel is jetted from the respective fuel distribution openings with a tangential velocity.

2. A fuel distribution device (9) for a burner, comprising:

an inlet end (9*a*) comprising a disc-like annular cover (19) having n inlet openings each configured to receive a high pressure fuel;

an outlet end (9*b*) comprising an annular support plate (11) in the form of a planar disc having n groups of fuel distribution openings from which the high pressure fuel is jetted, each of the groups including m fuel distribution openings respectively, wherein the m fuel distribution openings in the same group are distributed evenly along a circumference of the annular support plate (11) and the n groups of fuel distribution openings are arranged along the circumference of the annular support plate;

a cylindrical inner wall, a cylindrical outer wall, and a distribution channel (9*c*) defined by the annular cover (19), the annular support plate (11), the inner wall and the outer wall and forming an annular cavity;

n fuel feeding tubes (5) through which the high pressure fuel is jetted, the n fuel feeding tubes extending from the n inlet openings, respectively, of the annular cover (19) into the annular cavity of the distribution channel (9*c*), wherein each of the n fuel feeding tubes (5) is divided into m feeding branch pipes (8) extending within the annular cavity of the distribution channel (9*c*) from the fuel feeding tubes (5) to the annular support plate (11), and wherein the m feeding branch pipes (8) extending from the same fuel feeding tube (5) are in communication with the respective m fuel distribution openings in the same group respectively, and wherein m, n are positive integers greater than or equal to 2; and a fuel dividing mechanism (6) arranged between each of the n fuel feeding tubes (5) and the respective m feeding branch pipes (8), the fuel dividing mechanism comprising a multi-nozzle that divides the high pressure fuel received at the n inlet openings among the m feeding branch pipes through which the high pressure fuel is jetted;

wherein the feeding branch pipes (8) are configured to be coiled spirally about the inner wall and thus the feeding branch pipes (8) are configured to be tangentially inclinedly connected to the respective fuel distribution openings of the annular support plate (11) with respect to the annular support plate (11) such that high pressure fuel is jetted from the respective fuel distribution openings with a tangential velocity.

3. The fuel distribution device according to claim 2, wherein the m fuel distribution openings of any two of the n groups of distribution openings are arranged alternately along the circumference direction of the annular support plate (11) such that there is an interval angle of 360°/n×m formed between any two adjacent fuel distribution openings of the n×m fuel distribution openings.

4. The fuel distribution device according to claim 3, wherein the n×m fuel distribution openings are configured to be evenly distributed in the same circumference along the circumference direction of the annular support plate (11).

5. The fuel distribution device according to claim 2, wherein, a fuel dividing mechanism (6) is arranged between each of the fuel feeding tubes (5) and the respective m feeding branch pipes (8) extending therefrom.

6. The fuel distribution device according to claim 2, wherein an inner cooling jacket (14) is provided having a first coolant inlet and a first coolant outlet and defining the inner wall, and an outer cooling jacket (16) is provided having a second coolant inlet and a second coolant outlet and defining the outer wall.

7. A burner comprising:

an igniter (1);

an oxidant channel (12); and a fuel distribution device (9), wherein the oxidant channel (12) and the fuel distribution device (9) are coaxially and outwardly arranged about the igniter (1) in a manner of sequence, and wherein the fuel distribution device (9) comprises:

an inlet end (9*a*) comprising a disc-like annular cover (19) having n inlet openings each configured to receive a high pressure fuel, an outlet end (9*b*) comprising an annular support plate (11) in the form of a planar disc having n groups of fuel distribution openings from which the high pressure fuel is jetted, each of the groups including m fuel distribution openings respectively, wherein the m fuel distribution openings in the same group are distributed evenly along a circumference of the annular support plate (11) and the n groups of fuel distribution openings are arranged along the circumference of the annular support plate, a cylindrical inner wall, a cylindrical outer wall, and a distribution channel (9*c*) defined by the annular cover (19), the annular support plate (11), the inner wall and the outer wall and forming an annular cavity, n fuel feeding tubes (5) through which the high pressure fuel is jetted, the n fuel feeding tubes extending from the n inlet openings, respectively, of the annular cover (19) into the annular cavity of the distribution channel (9*c*), wherein each of the n fuel feeding tubes (5) is divided into m feeding branch pipes (8) extending within the annular cavity of the distribution channel (9*c*) from the fuel feeding tubes (5) to the annular support plate (11), and wherein the m feeding branch pipes (8) extending from the same fuel feeding tubes (5) are in communication with the respective m fuel distribution openings in the same group respectively, and wherein m, n are positive integers greater than or equal to 2; and a fuel dividing mechanism (6) arranged between each of the n fuel feeding tubes (5) and the respective m feeding branch pipes (8), the fuel dividing mechanism comprising a multi-nozzle that divides the high pressure fuel received at the n inlet openings among the m feeding branch pipes through which the high pressure fuel is jetted;

wherein the n inlet openings are distributed evenly along a circumference of the annular cover (19);

wherein the feeding branch pipes (8) are configured to be coiled spirally about the inner wall and thus the feeding branch pipes (8) are configured to be tangentially inclinedly connected to the respective fuel distribution openings of the annular support plate (11) with respect to the annular support plate (11) such that high pressure fuel is jetted from the respective fuel distribution openings with tangential velocity.

8. The burner according to claim 7, wherein, the burner further comprises an inner cooling jacket (14) arranged between the oxidant channel (12) and the distribution channel (9*c*) and having a first coolant inlet and a first coolant outlet and defining the inner wall, and an outer cooling jacket (16) arranged outwardly around the distribution channel (9*c*) and having a second coolant inlet and a second coolant outlet and defining the outer wall.

9. The burner according to claim 7, wherein, the m fuel distribution openings of any two of the n groups of distribution openings are arranged alternately along the circumference direction of the annular support plate (11) such that there is an interval angle of 360°/n×m formed between any two adjacent fuel distribution openings of the n×m fuel distribution openings.

10. The burner according to claim 9, wherein, the n×m fuel distribution openings are configured to be evenly distributed in the same circumference along the circumference direction of the annular support plate (11).

11. The fuel distribution device according to claim 6, wherein the inner cooling jacket (14) comprises a first annular cavity which is divided into a first inner cavity and a first outer cavity by a first baffle, wherein the first outer cavity is in communication with the first coolant inlet while the first inner cavity is in communication with the first coolant outlet.

12. The burner according to claim 7, wherein the fuel is powdered coal.

13. The fuel distribution device according to claim 2, wherein the annular cover (19) is configured to be parallel with the annular support plate (11).

14. The fuel distribution device according to claim 2, wherein the fuel distribution openings are configured such that the flame from each feeding branch pipe meets the flames from the neighboring feeding branch pipes in order to generate a loop of uniform fire.

15. The burner according to claim 7, wherein the annular cover (19) is configured to be parallel with the annular support plate (11).

16. The burner according to claim 7, wherein the fuel distribution openings are configured such that the flame from each feeding branch pipe meets the flames from the neighboring feeding branch pipes in order to generate a loop of uniform fire.

17. The fuel distribution device according to claim 6, wherein the outer cooling jacket (16) comprises a second annular cavity which is divided into a second inner cavity and a second outer cavity by a second baffle, wherein the second outer cavity is in communication with the second coolant inlet while the second inner cavity is in communication with the second coolant outlet.

18. The fuel distribution device according to claim 11, wherein the outer cooling jacket (16) comprises a second annular cavity which is divided into a second inner cavity and a second outer cavity by a second baffle, wherein the second outer cavity is in communication with the second coolant inlet while the second inner cavity is in communication with the second coolant outlet.

19. The fuel distribution device according to claim 2, wherein the distribution channel (9*c*) is sealed by the cover (19) at the inlet end (9*a*).

20. The burner according to claim 7, wherein the distribution channel (9*c*) is sealed by the cover (19) at the inlet end (9*a*).

* * * * *